United States Patent [19]

Burkey

[11] 4,082,241

[45] Apr. 4, 1978

[54] CHOCK FOR MOUNTAIN CLIMBING

[76] Inventor: John Brent Burkey, 3360 Quivas St., Denver, Colo. 80211

[21] Appl. No.: 696,906

[22] Filed: Jun. 17, 1976

[51] Int. Cl.[2] ..... A47G 29/00

[52] U.S. Cl. ..... 248/1; 24/115 R; 248/317

[58] Field of Search ..... 248/1, 317, 216, 343; 52/711, 706, 704; 24/73 R, 115 R; 188/32; 272/93; 182/87, 94, 228, 230

[56] References Cited

U.S. PATENT DOCUMENTS

| | | | |
|---|---|---|---|
| 1,409,524 | 3/1922 | Chase | 52/711 |
| 1,457,611 | 6/1923 | White | 52/706 |
| 1,485,596 | 3/1924 | Chase | 52/706 |
| 2,031,615 | 2/1936 | McKinney | 182/87 X |
| 3,110,908 | 11/1963 | Newgard | 52/711 X |
| 3,404,504 | 10/1968 | Taylor | 52/711 X |
| 3,467,351 | 9/1969 | Feverer | 24/73 R X |
| 3,479,785 | 11/1969 | Asch | 52/704 X |
| 3,946,975 | 3/1976 | Lyman | 248/317 X |
| 3,957,237 | 5/1976 | Campbell | 248/317 X |

*Primary Examiner*—J. Franklin Foss
*Attorney, Agent, or Firm*—John E. Reilly

[57] ABSTRACT

A chock for mountain climbers is in the form of a truncated pyramid having sides of unequal width so that the chock is readily conformable for secure wedging engagement virtually in any type of crevice, the chock being manufactured in different sizes according to variations in size of cracks or crevices encountered in mountain climbing. The configuration permits central placement of one end of a carabiner, the opposite free end of which is provided with a hero loop to permit fastening of a ring for direct connection of the climbing rope thereby obviating connection of an additional carabiner.

7 Claims, 10 Drawing Figures

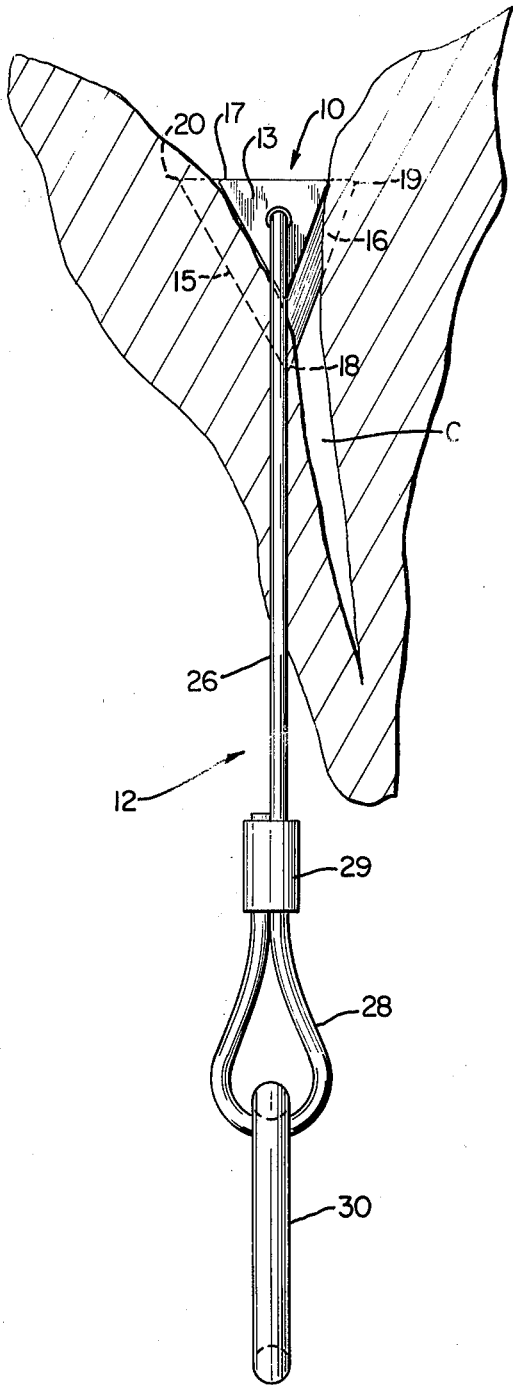
FIG. 1
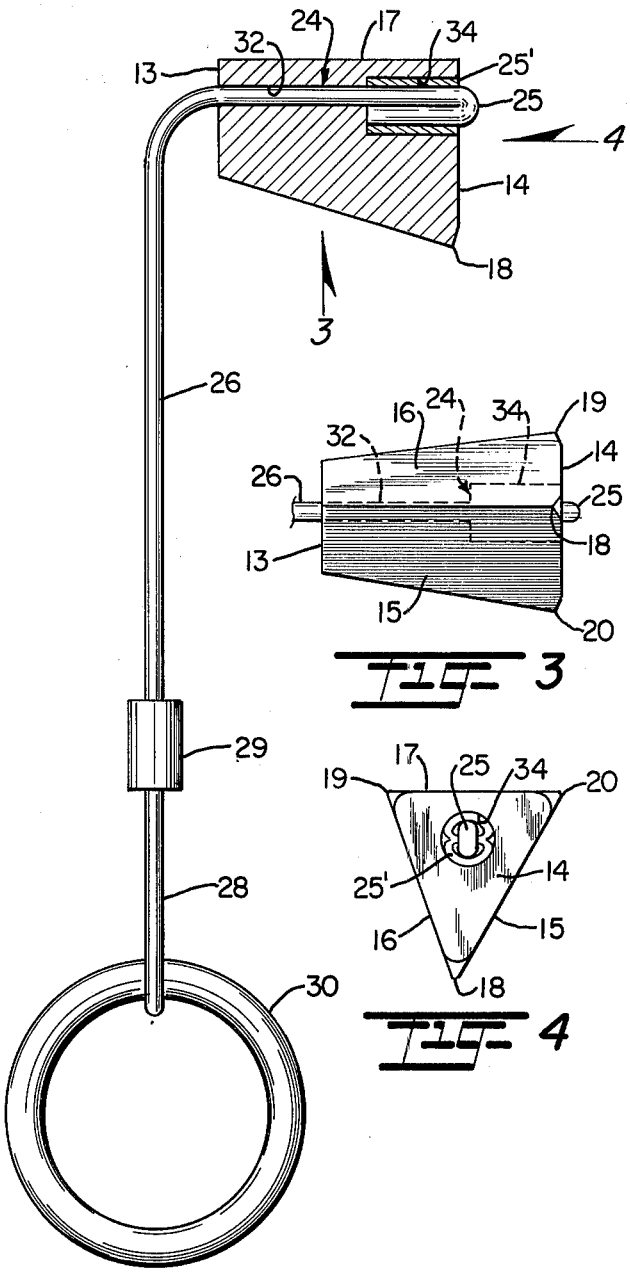
FIG. 2
FIG. 3
FIG. 4

CHOCK FOR MOUNTAIN CLIMBING

SPECIFICATION AND BACKGROUND OF THE INVENTION

This invention relates to novel and improved chocks; and more particularly relates to a mountain climbing chock as well as its use in combination with a carabiner in such a way as to establish firm wedging engagement in various cracks or crevices encountered in mountain climbing.

In mountain climbing, chocks are employed as temporary anchors for mounting climbers in various different sizes and shapes of cracks or crevices. Generally, the climbing rope is affixed to the chock by one or more carabiners in such a way as to facilitate positioning of the chock in a crack so that the weight of one or more climbers can be suspended from the climbing rope by means of the chock. Particularly in climbing steep cliffs or walls the need for a chock which will establish firm wedging engagement in a crack or crevice and will facilitate placement in a rapid positive manner will be readily apparent.

Various types of chocks have been devised for use in mountain climbing, such as, the Chouinard "Hexentric" Chock and the Forrest wedge-shaped chock which have probably been found to be most effective in the past for normal chock placement; i.e. any tapered or parallel side cracks or crevices encountered. Nevertheless, the above and other chocks commercially available have lacked the versatility and conformability required for efficient and dependable placement in all varieties of cracks or crevices encountered. For example, flared cracks are often encountered in which the crack narrows from the face of the rock inwardly; also piton scars left by other mountain climbers generally leave a square opening. In any event, the configuration of the particular crack or crevice which the mountain climber might desire to utilize for placement of the chock may be virtually of an infinite variety of specific shapes and sizes, as a result of which there is a very real need for a chock which will assure positive and secure wedging engagement notwithstanding such variations. In this relation, it should be borne in mind that the mountain climber is required to work fairly rapidly in the placement of each chock, and it is therefore important that one not be required to make a decision as to the specific configuration of the chock to be employed in each case.

In addition to the mountain climbing chocks referred to above which are presently commercially available, chocks have been devised for other uses, such as, vehicle chocks or leveling devices. Representative of such chocks are those disclosed in U.S. Pat. to Corson No. 2,954,101 which is directed to a generally wedge-shaped chock for vehicle wheels; Stonhaus No. 3,661,229 which also pertains to a wheel-positioning block employing generally triangular segments; and Feuerer No. 3,467,351 directed to an anchoring device which is adapted to be driven into a crevice but is more in the nature of a piton and intended more in mountain climbing to in effect make its own opening as it is driven into the rock formation.

SUMMARY OF THE INVENTION

It is therefore an object of the present invention to provide for a novel and improved chock which is specifically adaptable for use in mountain climbing.

It is another object of the present invention to provide for a mountain climbing chock which is characterized by its simplicity in construction and versatility in use in permitting placement in various different configurations and sizes of crevices in a rock formation.

A further object of the present invention is to provide a mountain climbing chock so constructed and arranged as to facilitate attachment of the climbing rope in a manner to assure optimum application of a load to the chock so as to greatly minimize accidental displacement of the chock from its wedging engagement in a rock formation.

It is an additional object of the present invention to provide for a mountain climbing chock assembly which greatly facilitates placement and positioning of the chock in position in a crack or crevice as well as direct attachment of a climbing rope to the chock assembly in a rapid, dependable manner.

In accordance with the present invention, a preferred form of chock for mountain climbers is broadly characterized by being in the form of a truncated pyramid having sides of unequal width and tapered along their lengths at substantially corresponding angles to one another so as to be conformable for placement in different configurations of cracks or crevices with one side forming a flattened bearing surface along one side of a crevice and the adjoining corner between the other sides of the chock bearing against the opposite side of the crevice. Formation of the sides of unequal length effectively forms different included angles between the three sides of the chock so that the angle of the bearing surface can be selected to most closely conform to the angle formed along one side of the crevice. In addition, a cable-receiving or rope opening, or openings, is formed to extend substantially along the major axis of the chock equidistant from the chock corners so that when the chock is wedged into a crack or crevice it will tend to more properly align itself with the proper leverage applied by the climbing rope along the major axis of the chock.

The invention is further characterized by a chock assembly in which a swage has one end inserted through the cable-receiving opening in the chock and positively fastened in place with the opposite end being looped to permanently affix a ring thereto whereby to eliminate necessity of looping and tying a second carabiner from the climbing rope to the first carabiner normally attached to a cable loop distal.

BRIEF DESCRIPTION OF THE DRAWINGS

Other objects, advantages and features will be more readily apparent in view of the following detailed description taken in conjunction with the drawings, in which:

FIG. 1 is an assembly view of a preferred form of chock assembly representing typical placement of the chock in a crevice.

FIG. 2 is a view partially in section of the chock assembly shown in FIG. 1.

FIG. 3 is an elevational view of the preferred form of chock.

FIG. 4 is a plan view of the preferred form of chock.

DETAILED DESCRIPTION OF THE PREFERRED EMBODIMENT

Figure 5:
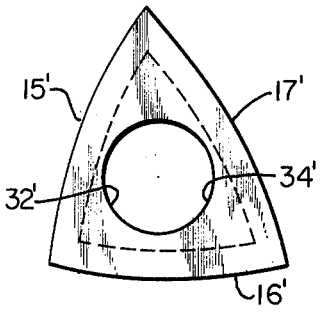
FIG. 5 is a plan view of a modified form of chock.

The present invention may be best exemplified by describing use of the preferred form of chock 10 in a chock assembly 12 for mountain climbing. As represented in FIG. 1 and further shown in more detail in FIGS. 2 to 4, the preferred form of chock 10 is defined by a main body portion in the form of a truncated pyramid having opposite ends 13 and 14 joined by sides 15, 16 and 17 which taper from the base or end 14 upwardly toward the opposite end 13. It will be readily apparent from a consideration of FIGS. 1 and 4 that the main body portion has a triangular cross section when taken in a plane transversely of the length or major axis of the pyramid, the sides each being of a width differing from the other two sides so that adjoining corners 18, 19 and 20 are at unequal distances from each of their respective opposite sides.

In order to provide for suspension of a climbing rope from the chock, a central cable-receiving opening or cavity 24 is formed in the chock for insertion of one end 25 of a cable or rope 26, the opposite end of the cable terminating in a looped portion 28 which is fastened together as at 29 for connection of a ring 30 thereto. Preferably the cable-receiving opening 24 includes a relatively small bore or groove 32 extending rearwardly from the smaller end 13 of the body to communicate with an enlarged area 34 so that the end of the cable 25 may be swaged or otherwise upset or enlarged as at 25' to permanently anchor it within the body portion of the chock.

FIG. 1 illustrates the manner in which the chock is preferably wedged in a crack or crevice with one side surface 15 forming a flat bearing surface against one side of the crevice C and the opposite corner 19 forming a bearing edge against the opposite side of the crevice. The side selected to form a bearing surface will of course depend upon the width and configuration of the crack or crevice and utilization of that side which will most nearly conform to the angle or degree of taper of the crack or crevice. In this relation, the tapered configuration of the body will permit firm wedging engagement of the chock in the crack along a substantial surface of one side as well as along the opposed corner or edge. However, it has been found that the combination of the point or line bearing contact with the flat bearing contact offered by a triangular chock body construction establishes firm wedging engagement with the greatest variety of configurations and sizes of crevices. In addition, by placing the cable-receiving opening along the major axis of the chock, any load suspended from the chock assembly such as by attachment of a climbing rope to the ring 30 is applied more uniformly throughout the chock so as not to tend to loosen or displace the chock but instead to increase its wedging engagement.

DESCRIPTION OF MODIFIED FORMS

Figure 6:
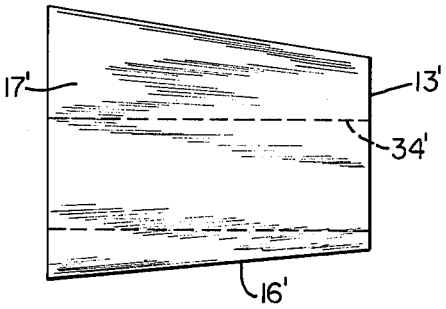
FIG. 6 is an elevational view of the modified form of chock shown in FIG. 5.
Figure 7:
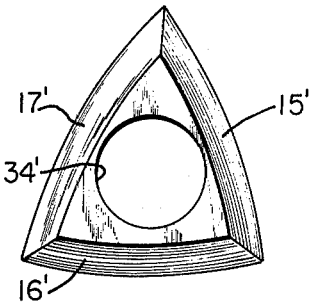
FIG. 7 is a plan view of the opposite end of the modified form of chock shown in FIGS. 5 and 6.

In the modified form of invention illustrated in FIGS. 5 to 7, like elements are correspondingly enumerated with prime numbers wherein a body portion has external triangular sides 15', 16' and 17' with a central cavity or bore 34' extending the length of the body, the bore having an inner circular wall surface in inner spaced concentric relations to the outer surfaces 15', 16' and 17'. In order to facilitate firm locking engagement of the end of the cable in the chock, the sides 15', 16' and 17' are initially of an outwardly bowed or convex configuration so as to enlarge the inner bore 34' and permit insertion of the cable into the cavity. Once in position, the side walls are squeezed or compressed inwardly by application of sufficient pressure to force them into a straight-sided configuration corresponding to that shown in FIGS. 1 to 4 and to firmly clamp the cable end in place. In the alternative the inner wall surface of the bore 34' may be triangular so as to be in spaced relation to the external sides 15', 16' and 17' substantially in the manner shown with respect to FIGS. 8 to 10 as hereinafter described.

Figure 8:
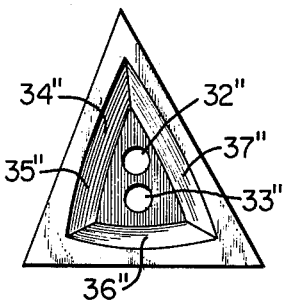
FIG. 8 is a plan view of another modified form of chock.
Figure 9:
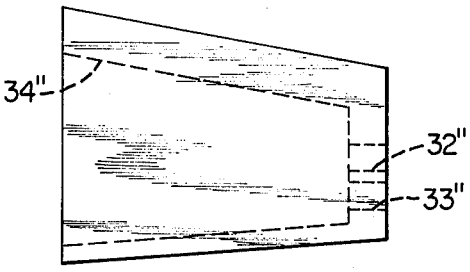
FIG. 9 is an elevational view of the modified form of chock shown in FIG. 8.
Figure 10:
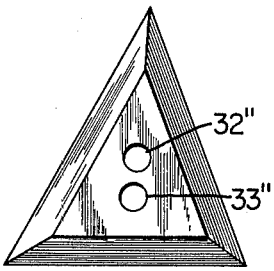
FIG. 10 is a plan view of the opposite end of the modified form of chock shown in FIGS. 8 and 9.

In the modified form shown in FIGS. 8 to 10, corresponding elements to the preferred form are once again correspondingly enumerated with double prime numbers. The distinguishing feature of the modified form shown in FIGS. 8 to 10 is to form the enlarged cavity 34" with inner, curved side walls 35", 36" and 37". In addition the cavity 34" communicates with a pair of laterally spaced openings 32" and 33" so that one end of the cable may be looped through one opening and returned through the other opening and securely swaged together such as by a coupling sleeve in the same manner as illustrated at the lower looped end portion 28 in FIG. 1. Once again the cable-receiving openings 32" and 33" are located symmetrically with respect to the longitudinal axis of the chock. In addition, the inner curved or convex side walls 35" to 37" serve to add additional thickness to the side walls of the chock. The modified forms of construction and arrangement as described with respect to FIGS. 8 to 10 is particularly useful in larger sized chocks; whereas the form shown in FIGS. 5 to 7 has been found to be most useful in the smaller sized chocks, and that of FIGS. 1 to 4 has been found to be preferable for medium sized chocks. For the purpose of illustration and not limitation, the medium sized chocks may have sides ranging in size from 0.6132 inch, a second side of 0.6789 inch and a third side of 0.7614 inch with an overall length of the chock body on the order of 0.76 inch. The smaller sized chock as embodied by FIGS. 5 to 7 may have a narrow side of approximately 0.18 inch, a second side of 0.20 inch and a third side on the order of 0.22 inch with an overall length of 0.22 inch. The larger size chock as illustrated in FIGS. 8 to 10 may have a shorter side on the order of 4.0 inches, a second side on the order of 4.34 inch and a longer side on the order of 4.86 inch, the overall length of the chock also being on the order of 4.86 inch. In each form the degree of taper of each side is on the order of 05° to the longitudinal axis.

It will be readily apparent that the relative width of the sides may vary as well as the degree of taper and overall length of the chock with respect to the width of the sides; also the chock may be four-sided with unequal sides but the three-sided triangular configuration has been found to offer a much better opportunity to establish corner-to-side bearing contact in different sizes and shaped of crevices. Similarly, the particular configuration of the central opening or cavity may vary although it is preferred to so design the central cavity and to permit affixation of the cable or rope end in such a way as to be substantially embedded within the outline of the chock body. In this relation it is further of particular advantage that the cable extend from the smaller end of the chock body so that the sides of the chock diverge away from the swage.

It is therefore to be understood from the foregoing description of a preferred and modified forms of invention that various changes may be made in the construction, dimensioning and sizing of parts without departing from the spirit and scope of the present invention as defined by the appended claims.

What is claimed is:

1. A mountain climbing chock comprising a body portion in the form of a truncated pyramid having a generally triangular cross-section in a plane transversely of the length of said body portion, the sides of said body portion being of unequal widths when measured at any point transversely of the length of said body portion, a cable-receiving opening disposed along the major, longitudinal axis of said body portion, and the adjoining corners between the sides of said body converging from one end to the opposite end of said body at substantially corresponding angles with respect to one another.

2. A mountain climbing chock according to claim 1, said cable receiving opening extending the substantial length of said body and defined by surrounding surface portions extending in inner spaced, substantially parallel relation to the external sides of said body.

3. A mountain climbing chock according to claim 1, said cable-receiving opening extending the greater length of said body portion and defined by surrounding surface portions in inner spaced relation to the external sides of said body so as to form a generally triangular shaped cable receiving opening.

4. A mountain climbing chock according to claim 3, the surrounding surface portions of said opening curving inwardly between adjoining corners.

5. A mountain climbing chock comprising a generally triangular body portion in the form of a truncated pyramid having a cross-section in a plane transversely of the length of said body portion, the sides of said body portion being of unequal widths, and a cable-receiving opening disposed under the major, longitudinal axis of said body portion, said cable-receiving opening extending the greater length of said body portion and defined by surrounding surface portions in inner spaced relation to the external sides of said body so as to form a generally triangular-shaped cable-receiving opening, the surrounding surface portions of said opening curving inwardly between adjoining corners, and a carabiner having one end extending through the cable receiving opening with means anchoring the one end of said carabiner in said body, the opposite end of said carabiner having a loop portion.

6. A mountain climbing chock according to claim 5, a ring permanently affixed within said loop portion of said carabiner.

7. A mountain climbing chock according to claim 5, the adjoining corners between the sides of said body converging from one end to the opposite end of said body at substantially corresponding angles with respect to one another.

* * * * *